US007624522B1

(12) United States Patent
Ammons

(10) Patent No.: US 7,624,522 B1
(45) Date of Patent: Dec. 1, 2009

(54) BUCKET CLEANING APPARATUS

(76) Inventor: Daniel Ammons, 238 Rose Dr., Brunswick, GA (US) 31520

( * ) Notice: Subject to any disclaimer, the term of this patent is extended or adjusted under 35 U.S.C. 154(b) by 0 days.

(21) Appl. No.: 11/998,004

(22) Filed: Nov. 29, 2007

(51) Int. Cl.
*E02F 3/40* (2006.01)
*B66C 23/00* (2006.01)

(52) U.S. Cl. ..... 37/444; 37/401; 37/426; 37/901; 414/725; 414/704

(58) Field of Classification Search ..... 37/442–445, 37/901, 424, 426; 414/725
See application file for complete search history.

(56) References Cited

U.S. PATENT DOCUMENTS

| | | | | | |
|---|---|---|---|---|---|
| 1,511,115 | A | * | 10/1924 | Downie | 37/401 |
| 2,172,672 | A | * | 9/1939 | Daniels | 37/426 |
| 2,262,310 | A | * | 11/1941 | Mack | 37/427 |
| 2,363,225 | A | * | 11/1944 | Brown | 37/426 |
| 2,380,285 | A | * | 7/1945 | Austin | 37/426 |
| 2,394,428 | A | * | 2/1946 | Cox | 37/426 |
| 2,402,299 | A | * | 6/1946 | Schield | 414/725 |
| 2,418,554 | A | * | 4/1947 | Kadz | 37/426 |
| 2,445,053 | A | * | 7/1948 | Allin | 37/431 |
| 2,501,489 | A | * | 3/1950 | Aisthorpe | 37/398 |
| 2,764,306 | A | * | 9/1956 | Dorkins | 414/704 |
| 2,786,591 | A | * | 3/1957 | Neumeister | 414/704 |
| 2,812,872 | A | * | 11/1957 | Perkins et al. | 414/704 |
| 2,858,035 | A | * | 10/1958 | Mettetal, Jr. | 414/704 |
| 2,939,595 | A | * | 6/1960 | Waite | 414/725 |
| 3,035,724 | A | * | 5/1962 | Clark et al. | 414/704 |
| 3,122,248 | A | * | 2/1964 | Campbell et al. | 414/725 |
| 3,176,863 | A | * | 4/1965 | Kuhl | 414/725 |
| 3,349,934 | A | * | 10/1967 | Moyer et al. | 414/704 |
| 3,380,604 | A | * | 4/1968 | Leese | 414/694 |
| 3,495,728 | A | * | 2/1970 | Long | 414/694 |
| 3,531,088 | A | * | 9/1970 | Kraschnewski | 254/292 |
| 3,630,396 | A | * | 12/1971 | Womack | 414/725 |
| 3,904,052 | A | * | 9/1975 | Nordstrom | 414/725 |
| 4,030,626 | A | * | 6/1977 | Durham | 414/704 |
| 4,035,936 | A | * | 7/1977 | Avara | 37/396 |
| 4,668,156 | A | * | 5/1987 | Mason | 414/704 |
| 5,241,764 | A | * | 9/1993 | Modig | 37/405 |
| 5,515,624 | A | * | 5/1996 | Beatty | 37/399 |
| 5,702,227 | A | * | 12/1997 | Berg | 414/704 |
| 5,970,636 | A | * | 10/1999 | Briscoe et al. | 37/396 |
| 6,038,795 | A | * | 3/2000 | Navarro | 37/341 |
| 2008/0134654 | A1 | * | 6/2008 | Kohler | 56/320.2 |
| 2008/0250768 | A1 | * | 10/2008 | Butler et al. | 56/320.2 |

* cited by examiner

*Primary Examiner*—Thomas A Beach
(74) *Attorney, Agent, or Firm*—Rodgers & Rodgers

(57) ABSTRACT

Excavator bucket cleaning apparatus having an action plate hingedly interconnected to the interior of the bucket with a cable attached at one end to the excavator boom and, at the other end, to the free end of the action plate so that rotation of the bucket outwardly causes the cable to tighten and swing the action plate outwardly of the bucket about the hinge.

4 Claims, 3 Drawing Sheets

BUCKET CLEANING APPARATUS

BACKGROUND OF THE INVENTION

Traditional excavating machines are widely used in a variety of digging operations especially in the digging of trenches. In day-to-day digging activities, varying soil conditions are encountered, oftentimes to include soil which is muddy, sticky and cohesive in nature. Under these types of conditions, when the bucket is to be emptied, the sticky soil tends to adhere to the inner surface of the bucket and is resistant to removal by simply tilting the bucket downwardly as would be desirable. When this occurs, it is necessary to rapidly shake the bucket or even strike the bucket on the ground in an effort to shake the sticky soil lose. If this is unsuccessful, it is necessary to manually remove the soil from the bucket by utilizing a shovel or like implement. Of course, these efforts can cause damage to the excavator and are quite time consuming.

BRIEF SUMMARY OF THE INVENTION

Excavator bucket cleaning apparatus including an action plate hingedly interconnected to the interior of the bucket and conforming generally to the bottom of the bucket with a cable attached to the action plate remote from the hinge at one end and attached to the boom at the other end. A pair of wear plates are attached to the excavator boom such that when the bucket is extended the cable tightens about the wear plates to cause withdrawal of the action plate from the bucket.

DETAILED DESCRIPTION OF THE INVENTION

Figure 4:
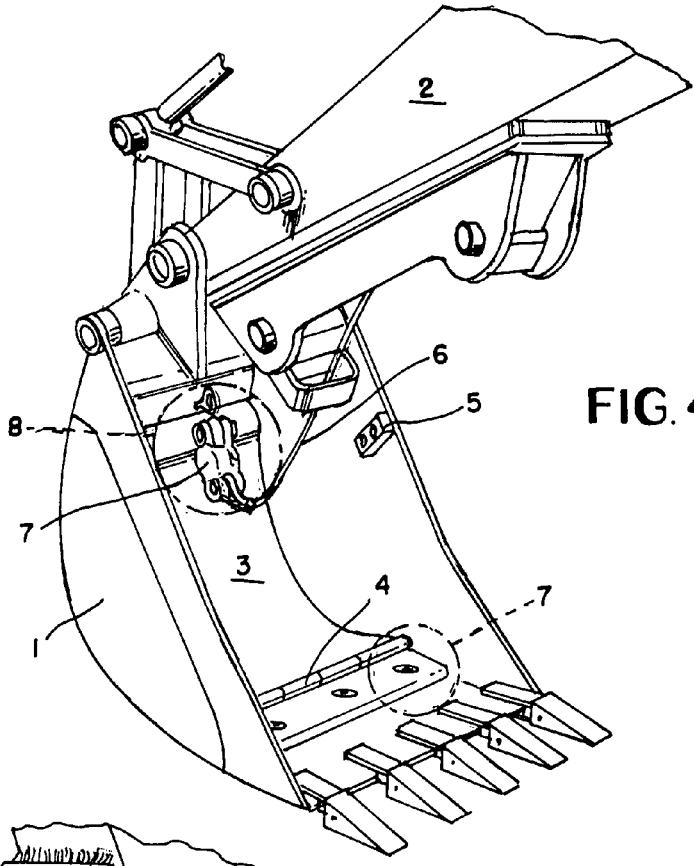
FIG. 4 is a perspective view of the excavator bucket cleaning apparatus.
Figure 5:
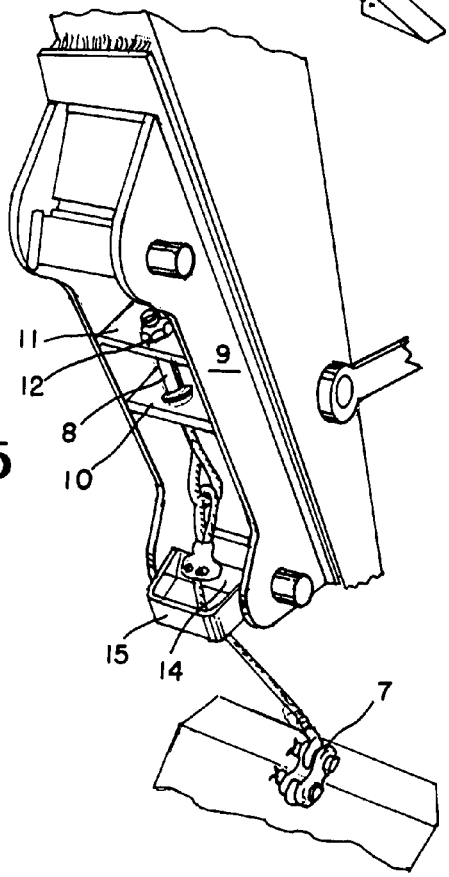
FIGS. 5 and 6 are enlarged views showing the action plate cable.
Figure 6:
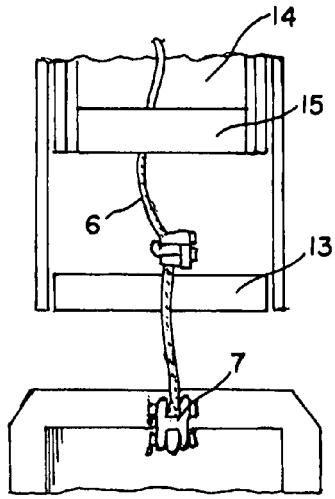

In the drawings and with particular reference to FIG. 4, the excavator bucket is designated by the numeral 1 and the numeral 2 identifies the excavator boom apparatus, the structural and operational details of which are well known in the art. According to this invention, action plate 3 is disposed within bucket 1 and is pivotally connected thereto by means of hinge 4. Action plate 3 is curved in shape to generally conform to the bottom configuration of bucket 1. Bolted to the inside side wall of bucket 1 is stop block 5 with an identical stop block bolted to the inside of the other side wall, although not shown in the drawings.

According to a feature of the invention, cable 6 is attached to action plate 3 by means of coupler 7 and, at the other end, is attached to boom 2 by means of adjustable attachment pin 8 which is housed within attachment block 9. Attachment pin 8 is secured within attachment block 9 by means of apertured plates 10 and 11. As is well known, attachment pin 8 is adjustable to either tighten or loosen cable 6 by simple manipulation of nut 12. In addition, a pair of cable wear plates 13 and 14 are secured to boom 2 such as by welding and the like. Band 15 is welded to boom 2 and acts to keep cable 6 in proximity to boom 2 so as not to interfere with the normal operation of bucket 1.

Figure 7:
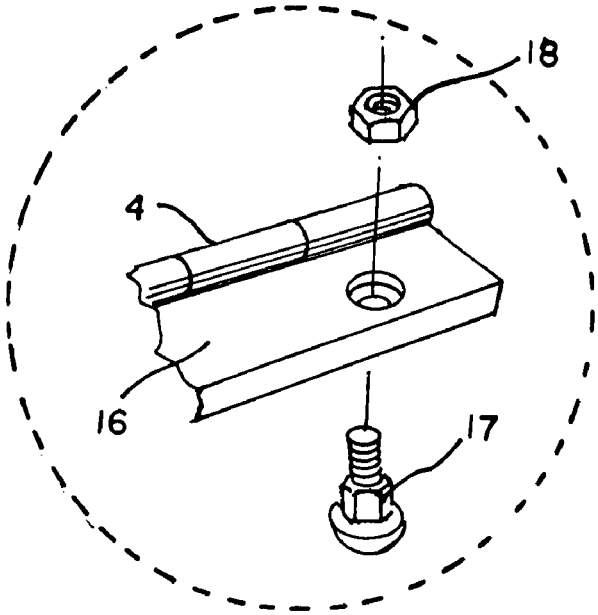
FIGS. 7 and 8 are enlarged fragmentary views of particular elements of the apparatus shown in FIG. 4.
Figure 8:
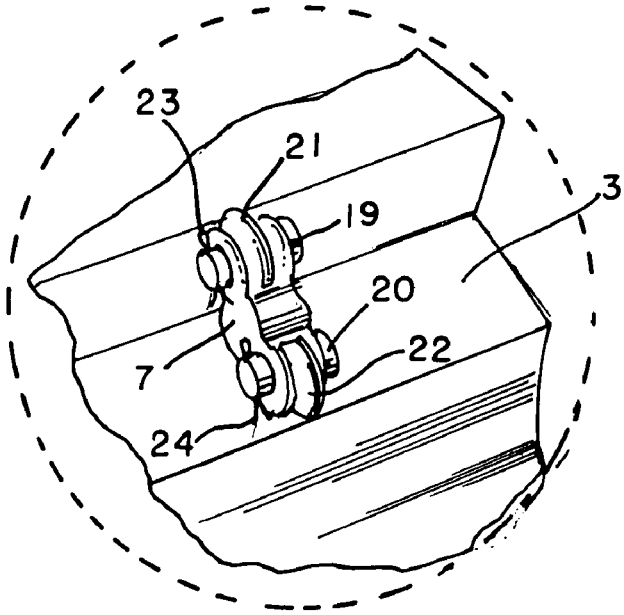

As shown in detail in FIG. 7, attachment block 16 is secured to bucket 1 by means of multiple bolts 17 and corresponding countersunk nuts 18. As previously described, action plate 3 is pivotally interconnected to bucket 1 by means of hinge 4 which is attached to attachment block 16. As shown in FIG. 8, cable 6 is attached to the free end of action plate 3 by means of coupler 7 which in turn is attached to action plate 3. Specifically, pins 19 and 20 extend through a pair of apertures disposed at opposite ends of coupler 7 and through eye screw 21 attached to action plate 3 and cable loop 22, respectively, and are secured in place by means of cotter pins 23 and 24, respectively. By this means, coupler 7 is easily detached from cable 6 by removing cotter pin 24 and then coupler 7 can be reattached to another bucket attachment, as needed.

Figure 1:
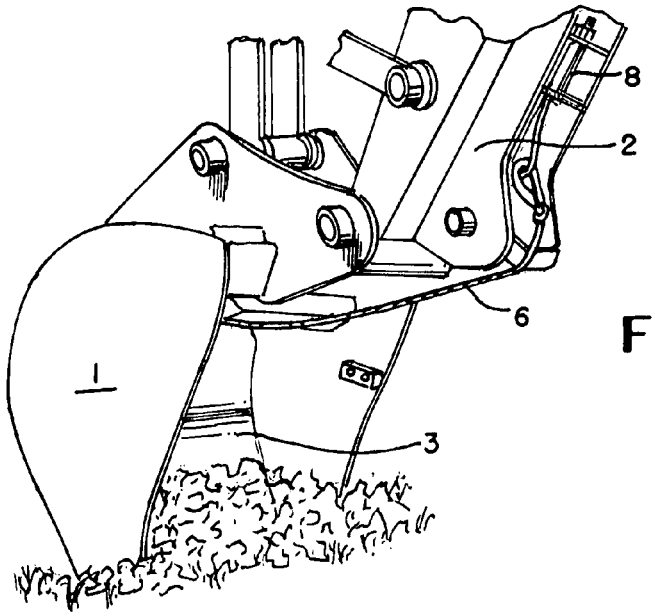
FIGS. 1, 2 and 3 depict the sequential operation of the bucket cleaning apparatus according to this invention.
Figure 2:
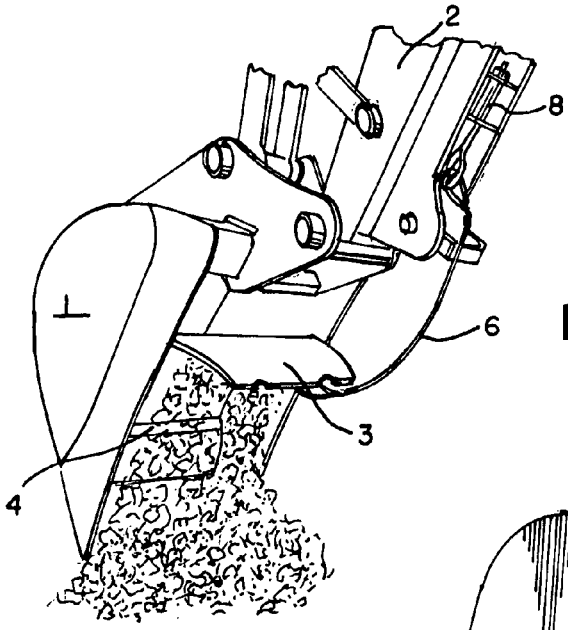
Figure 3:
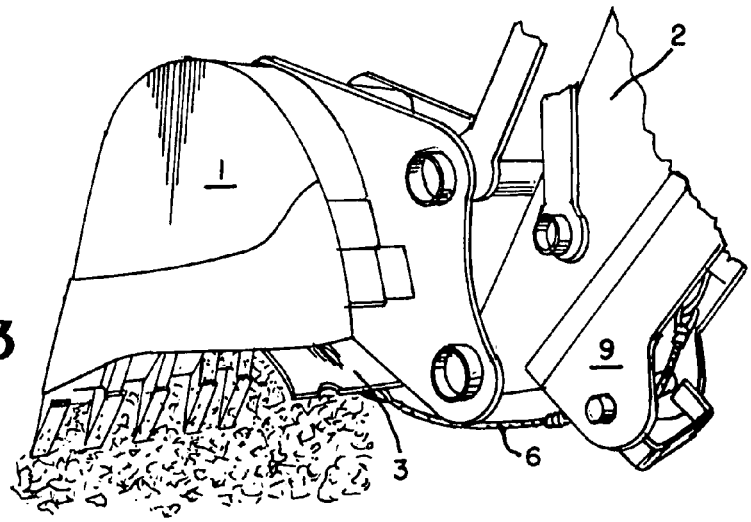

With reference to FIGS. 1, 2 and 3, in operation and accordance with this invention, the excavator is shown in FIG. 1 in a digging mode with action plate 3 in a retracted position. In FIG. 1, the material excavated is of a sticky and gummy consistency which tends to adhere to the sides and bottom of bucket 1. As the digging process proceeds, bucket 1 is rotated inwardly with respect to the excavator so as to fill bucket 1. When bucket 1 is emptied, it is rotated outwardly, as shown in FIGS. 2 and 3, causing cable 6 to tighten around wear plates 13 and 14 which in turn pulls on action plate 3 causing it to begin rotating outwardly of bucket 1 about hinge 4. As bucket 1 moves outwardly into its fully extended or dumping position, action plate 3 is fully rotated outwardly until it abuts stop blocks 5. With bucket 1 fully extended, as shown in FIG. 3 and with action plate 3 in its fully rotated position, the sticky material within bucket 1 simply falls away from bucket 1. In a successive digging operation, the material initially entering bucket 1 pushes action plate 3 rearwardly about hinge 4 into its normal retracted position.

Therefore, by this invention, an efficient and reliable means is provided to remove cohesive material from an excavator bucket thereby saving valuable time in an excavation operation and minimizing wear and tear on the excavator.

The invention claimed is:

1. Excavator bucket cleaning apparatus comprising an excavator boom, a bucket rotatable about the distal end of said boom, a rigid action plate pivoted to the interior of said bucket, said bucket comprising a curved bottom and said action plate being curved to conform generally to said bottom, a cable interconnecting said boom and the free end of said action plate, said cable being connected at one end to said action plate by means of a detachable coupler, said cable being adjustably interconnected at the other end to said boom, a pair of spaced wear plates being attached to said boom and being in intermittent contact with said cable, an attachment block being secured to said boom, said attachment block being multisided and open on one side, a pair of spaced plates secured within said attachment block, a pair of apertures disposed respectively in said plates, said cable extending through said apertures and said cable being interconnected to said boom by an attachment pin, said attachment pin being housed within said attachment block generally between said plates, and said coupler being pivotally interconnected to said action plate.

2. Apparatus according to claim 1 wherein a band is secured to said boom and said cable extends inside said band.

3. Apparatus according to claim 1 wherein an attachment plate is secured to the interior of said bucket and said action plate is pivotally interconnected to said attachment plate by means of a hinge.

4. Apparatus according to claim 1 wherein a pair of spaced side walls extend respectively perpendicular from the side edges of said bottom and a stop block is secured to the interior of one of said side walls.

* * * * *